United States Patent [19]

Gallaro et al.

[11] 4,272,701

[45] Jun. 9, 1981

[54] CATHODE RAY TUBE ARC LIMITING COATING

[75] Inventors: Anthony V. Gallaro; Joseph E. Lane, both of Auburn; G. Norman Williams, Seneca Falls, all of N.Y.

[73] Assignee: GTE Products Corporation, Stamford, Conn.

[21] Appl. No.: 70,278

[22] Filed: Aug. 27, 1979

[51] Int. Cl.[3] ..... H01J 29/88

[52] U.S. Cl. ..... 313/479; 313/450

[58] Field of Search ..... 313/479, 450

[56] References Cited

U.S. PATENT DOCUMENTS

| | | | |
|---|---|---|---|
| 4,052,641 | 10/1977 | Dominick et al. | 313/479 X |
| 4,163,919 | 8/1979 | Speigel | 313/479 |

*Primary Examiner*—Palmer C. Demeo
*Assistant Examiner*—Darwin R. Hostetter
*Attorney, Agent, or Firm*—Thomas H. Buffton

[57] ABSTRACT

A cathode ray tube includes an evacuated envelope having an inner surface supporting an arc limiting coating which includes insulator oxide particles, graphite particles and a silicate binder and is characterized by the improvement of insulator oxide particles having an exothermic heat of formation greater than the exothermic heat of formation of iron oxide.

12 Claims, 1 Drawing Figure

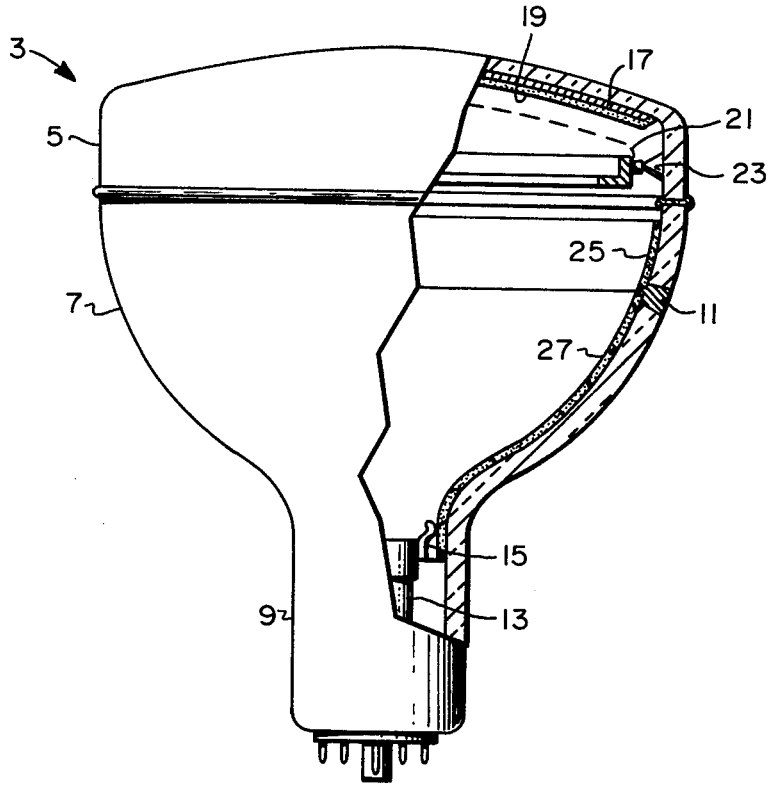
3
19
17
21
23
5
25
7
11
27
15
9
13

CATHODE RAY TUBE ARC LIMITING COATING

CROSS REFERENCE TO OTHER APPLICATIONS

An application entitled "A Cathode Ray Tube Having Internal Arc Limiting Coating" filed May 26, 1978 bearing U.S. Ser. No. 909,876, by the inventors of the present application and assigned to the Assignee of the present application relates to iron oxide coatings for cathode ray tubes.

TECHNICAL FIELD

This invention relates to cathode ray tubes and more particularly to an internal arc limiting coating for color cathode ray tubes comprising graphite particles, a silicate binder and insulator oxide particles having an exothermic heat of formation greater than that of iron oxide.

BACKGROUND OF THE INVENTION

Internal arc limiting coatings for cathode ray tubes have long been known. Such coatings have been utilized to provide a discharge path for secondary electrons emitted by the perforated mask when impinged by the primary electron beam. Normally, such coatings have been of the so-called "soft" aquadag variety which are primarily graphite dispersed in a binder material. Moreover, the coating is disposed intermediate a viewing screen, an anode button electrode and a mount assembly sealed into the envelope.

However, the appearance of solid state circuitry added complexity to the arcing problem because of the tendency toward catastrophic failure of the semiconductors of the solid state circuitry whenever a high current or arc current was transmitted to the circuitry by way of the internal coating and high voltage anode button. Thus, inhibition of currents developed by undesired arcing within the cathode ray tube became necessary and a replacement for the so-called "soft" aquadag coating was developed.

One form of replacement coating is an arc resistive coating utilizing a glass frit and a conductive oxide such as cadmium or copper oxide. This arc resistive coating provides a relatively high resistance whereby arc currents are limited and catastrophic semi-conductor failures inhibited. Moreover, such a coating is set forth and discussed in U.S. Pat. No. 4,124,540 issued to Foreman et al. on Nov. 7, 1978 and assigned to the Assignee of the present application.

Although the above-mentioned "soft" aquadag and so-called "frit" type coatings have been and still are utilized in some applications with excellent results, it has been found that there are other applications wherein such coatings leave something to be desired. Moreover, the "soft" aquadag coatings tend toward undesired loose particles and arcing while the so-called "frit" type coatings are most difficult to salvage and are expensive of labor and materials.

In an effort to reduce the above-mentioned arcing problems and provide a salvageable but relatively inexpensive resistance coating, the so-called iron oxide type coatings were developed. As exemplified by U.S. Pat. No. 3,791,546 issued to Maley et al., an iron oxide, graphite and alkali silicate coating was provided. This coating had an oxide to graphite ratio in the range of about 2:1 to 6:1 which unfortunately tended to provide an excessive amount of graphite particles and these excess graphite particles became loose and tended to cause arcing.

Additionally, it has been found that the iron oxide mixed with the graphite tends to undesirably reduce due to the relatively high temperatures produced by the electron beam impingement occurring in a cathode ray tube. Unfortunately, the iron oxide is reduced to a lower oxide or even a metallic iron producing carbon monoxide and carbon dioxide. Such a reaction is indicated by the formulation:

$$Fe_2O_3+2C \rightarrow FeO+Fe+CO+CO_2$$

Thereafter, the carbon monoxide or carbon dioxide oxidizes any free barium at the surface of the cathode of the cathode ray tube to provide barium oxide.

$$CO+Ba \rightarrow C+BaO$$

$$CO_2+2Ba \rightarrow C+2BaO$$

This depletion of the free barium at the surface of the cathode undesirably raises the work function and lowers the electron emission for a given amount of power input. As a result of this reduced emission, premature and often times catastrophic tube failure is encountered.

OBJECTS AND SUMMARY OF THE INVENTION

Therefore, it is an object of the invention to provide a cathode ray tube having improved arc limiting capabilities. Another object of the invention is to provide an internal coating for a cathode ray tube which improves the arc limiting capabilities and has good adherence with a reduced tendency toward loose particles. Still another object of the invention is to provide a cathode ray tube internal arc limiting coating having materials therein with an exothermic head of formation greater than iron oxide.

These and other objects, advantages and capabilities are achieved in one aspect of the invention by a coating which includes graphite particles, insulator oxide particles and a silicate binder and characterized by oxide particles having a higher exothermic heat of formation than that of iron oxide.

BRIEF DESCRIPTION OF THE DRAWINGS

The sole FIGURE is an illustration, partially broken-away, of the cathode ray tube utilizing the coating of the invention.

BEST MODE FOR CARRYING OUT THE INVENTION

For a better understanding of the present invention, together with other and further objects, advantages and capabilities thereof, reference is made to the following disclosure and appended claims in conjunction with the accompanying drawing.

Referring to the drawing, a cathode ray tube includes an envelope 3 having a panel member 5 sealed to a funnel portion 7 connected to a neck portion 9. An anode button 11 suitable for connection to a higher voltage source is embedded in the funnel portion 7 and a mount assembly 13 having affixed snubber members 15 is sealed into the neck portion 9 of the envelope 3.

In the usual manner, the panel member 5 has an inner surface whereon is deposited a luminescent layer 17 of phosphor materials with a layer 19 of light reflecting metal affixed thereto. A perforated mask member 21 is spaced from the light reflecting metal layer 19 and attached to a support member 23 on the panel member 5.

A coating 25 of an electrically conductive material, such as "aquadag" for example, is disposed on the inner surface of the envelope 3 intermediate the anode button 11 and the perforated mask member 21. Importantly, an arc limiting coating is adhered to the inner surface of the envelope 3 intermediate the anode button 11 and the snubber members 15 of the mount assembly 13.

In fabricating the cathode ray tube, the arc limiting coating 27 is applied, from a suspension, to the funnel and neck portions 7 and 9 of the envelope 3. Preferably, the funnel and neck portions 7 and 9 are rotated and the suspension is applied thereto by a brush. Thus, the arc limiting coating 27 is disposed intermediate the anode button 11 and the location whereat the snubber member 15 would come into contact therewith. However, it may be noted that the arc limiting coating 27 may also be in the form of a narrow band intermediate the anode button 11 and snubber members 15 or extend from the snubber members 15 to the screen member 21.

Thereafter, the electrically conductive material or "aquadag" coating 25 is sprayed or sponged or brushed onto the funnel portion 7 such that the "aquadag" coating 25 overlaps the arc limiting coating 27 in the vicinity of the anode button 11. Then, the panel member 5 containing the previously prepared luminescent layer 17, light reflecting metal layer 19, and perforated screen member 21 is placed in contact with a bead of glass frit sealing material affixed to the rim of the funnel portion 7. Following, the assembly is heated to a temperature of about 450° C. whereupon the panel member 5 is frit sealed to the funnel portion 7 and the "aquadag" coating 25 and arc limiting coating 27 are thoroughly dried.

Following, the mount assembly 13 having the affixed snubber members 15 is slid into the neck portion 9 of the envelope 3 and sealed thereto. Thus, the snubber members 15 are placed in contact with and slid across the arc limiting coating 27. Obviously, it can readily be seen that such a method for establishing contact between the snubber members 15 and the arc limiting coating 27 presents a good possibility for effecting loose particles of the arc limiting coating 27 should the coating 27 lack the necessary degree of hardness. Thereafter, the complete cathode ray tube is baked, exhausted, and sealed in a manner well known in the art.

Referring more specifically to the arc limiting coating 27, it has previously been mentioned that iron oxide ($Fe_2O_3$) tends to reduce to provide carbon monoxide and carbon dioxide which combines with free barium to undesirably deplete the supply thereof at the cathode surface of a cathode ray tube. As a result, the emission capabilities of the cathode ray tube are reduced and tube failure occurs.

However, it is known that the heat evolved or absorbed when a compound is formed by the direct union of its elements is known as the heat of formation of the compound. Moreover, if the reaction is exothermic, heat is evolved. Since the same amount of heat must be put back into the system to dissociate the compound into its respective elements, a higher exothermic heat of formation indicates a more vigorous reaction for compound formation and a more stable compound.

As a result, compounds having an exothermic heat of formation greater than that of iron oxide have been found especially suitable as insulator oxides in arc limiting coatings. Preferably, insulator oxides having an exothermic heat of formation greater than about 200 kg cal/mole such as particles of chromic oxide, aluminum oxide and titanium dioxide, for example, are especially applicable to arc limiting coatings for cathode ray tubes.

Further detailing the arc limiting coating 27, the coating 27 is fabricated to utilize minimal amounts of conductive graphite particles and increased amounts of insulative oxide particles. More specifically, the weight ratio of insulator oxide particles to graphite particles of the arc limiting coating 27 is in the range of about 5:1 to 16:1. Thus, the coating 27 is especially resistant to abrasion and the undesired production of loose particles of electrically conductive materials which would tend to produce undesired arcing.

In more detail, a preferred formulation includes insulator oxide particles in the range of about 50–65 weight parts, graphite particles in the range of about 4–10 weight parts, and silicate solids in the range of about 25–35 weight parts. Moreover, minimal amounts of graphite particles and silicate solids are selected in order to minimize undesired arcing due to loose conductive particles and undesired extended life problems sometimes encountered when an excess of silicates are present.

Additionally, it has been found that the commonly employed technique of utilizing the resistance measurement of the coating as a criteria of the arc current limiting capability leaves much to be desired. Rather, a more accurate determination of arc limiting capability of the coating is obtainable by measurement of both resistance and impedance of the coating. More specifically, resistance and capacitance measurements have been found meaningful in judging the arc limiting capability of a coating.

As a result, a minimal amount of conductive material, or graphite in this instance, which is well dispersed throughout the suspension whereby each conductive particle is well isolated from other conductive particles, has been found most suitable. More specifically, a weight ratio of insulator oxide particles to graphite particles in the range of about 5:1 to 16:1 has been found appropriate. Also, a resistance value in the range of about 5 to 1000 K-ohms and preferably 50K to 1000 K-ohms and a capacity of about 3 to 300 picofarads, as measured along a four-inch linear band between the anode button 11 and the snubber members 15, have been found suitable to the above-mentioned coating and particle ratio.

As an example of a typical, but not limiting, formulation for providing the arc limiting coating 27, 40 grams of chromic oxide was mixed with 46 ml of PS-Kasil, a 35% by weight potassium silicate produced by GTE Sylvania, Inc., Towanda, Pa. and 30-ml of water. This mixture was ball milled for 24 hours in a ½ pint burundum jar with ½-inch burundum cylinders.

Then, 6 drops of ammonium hydroxide and 40 ml of Pierce and Stevens aquadag, manufactured by the Pierce and Stevens Chemical Co., Buffalo, N.Y. are added to the mixture and ball milled for 2 hours. Thereafter, the completed formulation is transferred to a clean bottle and applied, by brushing preferably, to approximately 4-linear inches of the neck and funnel portions 7 and 9 on the inner surface of the envelope 3.

The resultant arc limiting coating 27 has provided resistance values well within the range of 5K to 1000 K-ohms and preferably in the range of 50K to 1000 K-ohms as well as capacitance values well within the 3 to 300 pico-farad range. Moreover, the coating 27 is especially suitable to high voltage conditioning wherein relatively high potentials are employed to remove undesired loose particles or burrs whereat undesired arcs may occur.

Additionally, chromic oxide and iron oxide type insulator oxide particles were utilized in an arc limiting coating and compared for carbon dioxide pressure both initially and after 30 minutes of scanning by an electron beam with the following result:

| $CO_2$ MM pressure (initially) | $CO_2$ MM pressure After 30-min. scan |
|---|---|
| $CR_2O_3$-$1.5 \times 10^{-9}$ | $1.5 \times 10^{-9}$ |
| $Fe_2O_3$-$1.8 \times 10^{-7}$ | $5.8 \times 10^{-7}$ |

As can readily be seen, the arc limiting coating 27 having an insulator oxide ($Cr_2O_3$) with an exothermic heat of formation greater than that of iron oxide exhibits a greater stability in that the carbon dioxide pressure remains substantially unchanged after 30 minutes of scanning by an electron beam. As previously mentioned, an increase in carbon dioxide pressure in a cathode ray tube is deleterious to the free barium available at the cathode surface and ultimately to the electron emission capabilities of the cathode ray tube.

Also, binder materials other than the preferred potassium silicate are proper and provide acceptable results. For example, sodium silicates and lithium silicate, alone or in combination with one another or with potassium silicates, are appropriate to the abovementioned formulations.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

A unique arc limiting coating for a cathode ray tube has been provided. The coating employs oxide particles having a heat of formation greater than the exothermic heat of formation of iron oxide whereby emission and life stability of the cathode ray tube is enhanced. Also, a minimal amount of graphite particles are employed in a well dispersed mixture whereupon the coating adheres to the surface of the cathode ray tube and has a resistance to abrasion such that the occurrance of undesired loose particles are greatly reduced.

We claim:

1. In a cathode ray tube having an evacuated envelope including a funnel member and an arc limiting coating affixed to at least a portion of the inner surface of said funnel member wherein said arc limiting coating includes graphite particles, a silicate binder and insulator oxide particles, the improvement wherein said oxide particles have an exothermic heat of formation greater than the exothermic heat of formation of iron oxide.

2. The improvement of claim 1 wherein said insulator oxide particles have an exothermic heat of formation equal to or greater than about 200 Kg cal/mole.

3. The improvement of claim 1 wherein said insulator oxide particles are in the form of chromic oxides particles.

4. The improvement of claim 1 wherein said insulator oxide particles are in the form of aluminum oxide particles.

5. The improvement of claim 1 wherein said insulator oxide particles are in the form of titanium diode particles.

6. The improvement of claim 1 wherein said insulator oxide particles and graphite particles are in the range of about 5:1 to 16:1.

7. The improvement of claim 1 wherein said arc limiting coating has a resistance in the range of about 50 K-ohm to 1000 K-ohms and a capacitance in the range of about 3 to 300 pico-farads.

8. In a cathode ray tube having an evacuated envelope including a face panel sealed to a funnel portion extending to a neck portion with an anode button sealed into the funnel portion and a mount assembly with affixed snubber members sealed into said neck portion and an arc limiting coating affixed to the internal surface of said neck and funnel portions and contacting said snubber members of said mount assembly and characterized by the improvement wherein said arc limiting coating includes insulator oxide particles, graphite particles and a silicate binder with said insulator oxide particles having an exothermic heat of formation greater than the exothermic heat of formation of iron oxide and said insulator oxide and graphite particles are in the range of about 5:1 to 16:1 with said coating having a resistance in the range of about 50 K-ohms to 1000 K-ohms and a capacitance in the range of about 3 to 300 pico-farads.

9. The improvement of claim 8 wherein said insulator oxide particles have an exothermic heat of formation equal to or greater than about 200 Kg Cal/mole.

10. The improvement of claim 8 wherein said insulator oxide particles are aluminum oxide particles.

11. The improvement of claim 8 wherein said insulator oxide particles are chromic oxide particles.

12. The improvement of claim 8 wherein said insulator oxide particles are titanium dioxide particles.

* * * * *